US008453725B2

(12) United States Patent
Brennan, III

(10) Patent No.: US 8,453,725 B2
(45) Date of Patent: Jun. 4, 2013

(54) COMPLIANT PACKERS FOR FORMATION TESTERS

(75) Inventor: William E. Brennan, III, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 284 days.

(21) Appl. No.: 12/837,146

(22) Filed: Jul. 15, 2010

(65) Prior Publication Data

US 2012/0012304 A1 Jan. 19, 2012

(51) Int. Cl.
*E21B 49/10* (2006.01)

(52) U.S. Cl.
USPC ..... 166/100; 166/101; 166/250.17; 166/264; 73/152.26; 73/152.36

(58) Field of Classification Search
USPC ..... 166/250.17, 264, 101, 100; 175/152.36, 175/152.17, 152.26; 73/152.36, 152.17, 152.26
See application file for complete search history.

(56) References Cited

U.S. PATENT DOCUMENTS

| | | | | |
|---|---|---|---|---|
| 2,821,256 | A | 1/1958 | Boller | |
| 3,173,485 | A * | 3/1965 | Bretzke, Jr. | 166/100 |
| 3,344,860 | A * | 10/1967 | Voetter | 166/100 |
| 3,565,169 | A | 2/1971 | Bell | |
| 4,287,946 | A | 9/1981 | Brieger | |
| 6,729,399 | B2 | 5/2004 | Follini et al. | |
| 7,114,385 | B2 | 10/2006 | Fisseler et al. | |
| 8,220,536 | B2 * | 7/2012 | Tao et al. | 166/100 |
| 8,235,106 | B2 * | 8/2012 | Fox et al. | 166/100 |
| 2004/0173351 | A1 | 9/2004 | Fox et al. | |
| 2005/0161218 | A1 * | 7/2005 | van Zuilekom et al. | 166/264 |
| 2006/0075813 | A1 * | 4/2006 | Fisseler et al. | 73/152.26 |
| 2006/0076132 | A1 * | 4/2006 | Nold et al. | 166/264 |
| 2007/0151727 | A1 | 7/2007 | Tao et al. | |
| 2010/0132940 | A1 * | 6/2010 | Proett et al. | 166/250.17 |
| 2012/0012304 | A1 * | 1/2012 | Brennan, III | 166/118 |

* cited by examiner

*Primary Examiner* — Jennifer H Gay
(74) *Attorney, Agent, or Firm* — Cathy Hewitt; John Vereb

(57) ABSTRACT

In one embodiment, an apparatus includes a base plate having a first aperture to receive an inlet in fluid communication with a downhole tool; a compliant outer cover having a first end terminating at the base plate and a second end terminating adjacent a forward opening of the inlet, the compliant outer cover having a first surface configured to engage a borehole wall and a second surface forming an inner cavity with the base plate; and a core disposed within the inner cavity and having a second aperture forming at least a portion of the inlet, wherein the outer cover comprises a first material and the core comprises a second material more compliant than the first material.

20 Claims, 4 Drawing Sheets

COMPLIANT PACKERS FOR FORMATION TESTERS

BACKGROUND OF THE DISCLOSURE

During a drilling operation, it may be desirable to evaluate and/or measure properties of encountered formations and formation fluids. In some cases, a drillstring is removed from a wellbore or borehole and a wireline tool is deployed into the borehole to test, evaluate and/or sample the formations and/or formation fluid(s). In other cases, the drillstring may be provided with devices to test, evaluate and/or sample the surrounding formations and/or formation fluid(s) without having to remove the drillstring from the borehole.

The formation testers of the drillstring and/or wireline tool may be used to, for example, evaluate and sample hydrocarbons extracted from a formation. Formation testers typically include a probe to gather fluid samples from the formation. A packer is often provided with the probe to create a seal against a wall of the borehole adjacent the formation. With a seal established between the borehole wall and the packer, fluid can be drawn from the formation into the formation tester.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
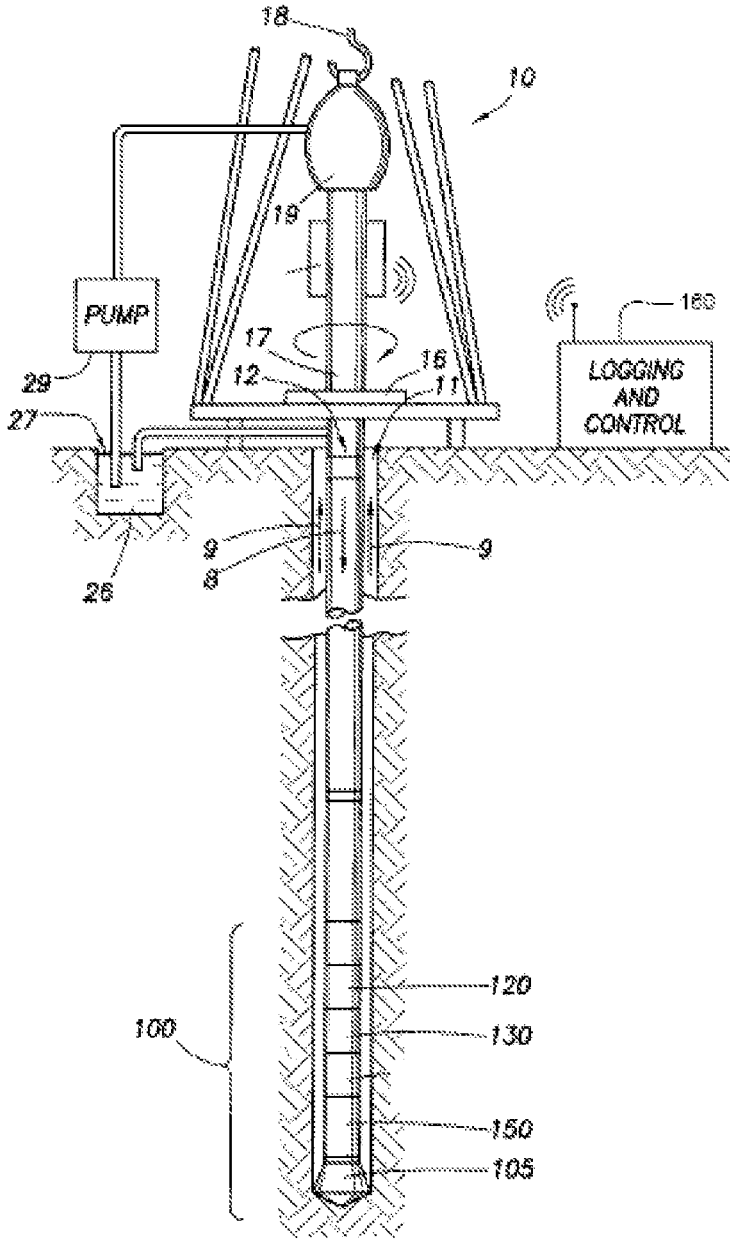
FIG. 1 is a schematic view of apparatus according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the present disclosure relate to compliant packers for formation testers. Formation testers and the packers thereof are typically deployed in a harsh environment within boreholes. Depending on the geographic location of a borehole, the depth of deployment of the formation tester in the borehole, the size of the borehole and/or other factors, packers of the formation testers may be exposed to varying hazardous conditions. For example, a packer may be required to withstand high temperatures and/or pressure levels, both of which may adversely affect the integrity of the packer. Further, repeated and forceful contact with borehole walls may cause deterioration of the packer.

Any such loss of integrity and/or deterioration of the packer may decrease the ability of the packer to form a sufficient seal with a borehole wall and, thus, the ability of the formation tester to function properly and/or efficiently. When a packer fails to form a sufficient seal with a borehole wall, fluid samples collected by the formation tester may be contaminated with borehole fluids (e.g., drilling fluid), and/or the formation tester may be incapable of creating the necessary pressure differential to draw fluids, among other problems. Therefore, some packers are constructed with rigid materials, such as metal, capable of withstanding the harsh conditions and rugged operation experienced by a packer.

However, many borehole walls are uneven and rough. A highly rigid packer may have difficulty conforming to the topology of such a borehole wall and, therefore, may have difficulty forming a proper seal against the borehole wall. In many instances, a packer composed of a highly rigid material may be incapable of adapting or conforming to the walls of boreholes of different sizes and/or shapes. As a result, multiple differently sized packers may be needed to perform sampling operations in such differently sized and/or shaped boreholes. Furthermore, a highly rigid packer may fail to evenly distribute borehole contact forces applied to the packer and/or, more generally, the probe. As with many devices or tools, an uneven distribution of applied forces may lead to rapid deterioration or wear of certain components or portions of the device or tool. Therefore, some packers are constructed with compliant materials, such as rubber, more capable of conforming to a shape of a wellbore or borehole wall and more capable of evenly distributing contact force(s) than rigid materials.

According to one or more aspects of this disclosure, a packer may be provided with an outer shell or cover of a first compliant material forming an inner cavity. A core of a second material more compliant than the first material may be disposed within the inner cavity to support the outer shell or cover. Such a configuration enables the less compliant (i.e., more rigid) outer shell or cover to withstand the harsh conditions experienced by downhole tools and/or to provide support for the differential pressure developed during, for example, a testing operation, while simultaneously enabling the more compliant (i.e., less rigid) core to assist the packer in conforming to a profile of a wellbore or borehole wall and/or in forming a good seal therewith. A second core may also be disposed within the inner cavity to support the outer shell or cover and/or the first core. The second core may be constructed of a third material more compliant than the outer shell or cover, thereby further assisting (e.g., in conjunction with the first core) the packer in conforming to the profile of the wellbore or borehole wall. The examples described herein may include additional and/or alternative configurations and/or numbers of elements, each of which may contribute to the ability of the packer to withstand the harsh conditions of the borehole, conform to the borehole wall, provide a seal, and/or provide support for the differential pressure developed during, for example, a testing operation.

According to one or more aspects of this disclosure, a packer may be provided with an outer shell or cover of a first compliant material forming a first portion of an outer surface of the packer. A second portion of the outer surface may be formed by a first core of a second material more compliant than the first material. The more compliant first core, which may be disposed adjacent an inlet of a corresponding formation tester, enables an effective seal to be formed with a borehole wall, while the less compliant outer shell or cover enables the packer to withstand the harsh conditions of the borehole and/or to provide support for the differential pressure developed during, for example, a testing operation. A second core may also be disposed in conjunction with the outer shell or cover and the first core to further assist the packer in conforming to a profile of the borehole wall to form the seal therewith. The second core may be, for example, a bladder filled with a fluid, a solid material, and/or a semi-solid material.

FIG. 1 depicts a wellsite system including a downhole tool(s) which may be configured according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drillstring 12 is suspended in the borehole 11 and includes a bottom hole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drillstring 12 is rotated by the rotary table 16, energized by means not shown, which engages the kelly 17 at an upper end of the drillstring 12. The example drillstring 12 is suspended from the hook 18, which is attached to a traveling block (not shown), and through the kelly 17 and the rotary swivel 19, which permits rotation of the drillstring 12 relative to the hook 18. Additionally or alternatively, a top drive system could be used.

In the example depicted in FIG. 1, the surface system further includes drilling fluid 26, which is commonly referred to in the industry as "mud," and which is stored in a pit 27 formed at the well site. A pump 29 delivers the drilling fluid 26 to the interior of the drillstring 12 via a port in the rotary swivel 19, causing the drilling fluid 26 to flow downwardly through the drillstring 12 as indicated by the directional arrow 8. The drilling fluid 26 exits the drillstring 12 via ports in the drill bit 105, and then circulates upwardly through the annulus region between the outside of the drillstring 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the drill bit 105 azimuth and inclination that may be used to monitor the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
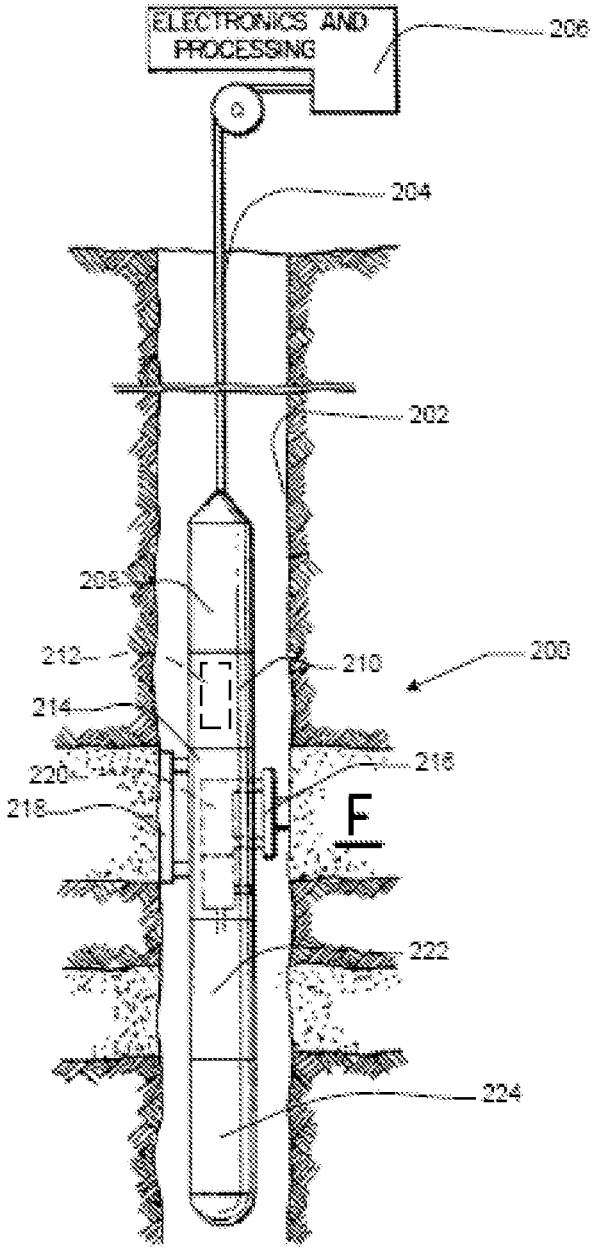
FIG. 2 is a schematic view of apparatus according to one or more aspects of the present disclosure.

FIG. 2 depicts an example wireline system including a downhole tool(s) that may be configured according to one or more aspects of the present disclosure. The example wireline tool 200 may be used to extract and analyze formation fluid samples and is suspended in a borehole or wellbore 202 from the lower end of a multiconductor cable 204 that is spooled on a winch (not shown) at the surface. At the surface, the cable 204 is communicatively coupled to an electrical control and data acquisition system 206. The tool 200 has an elongated body 208 that includes a housing 210 having a tool control system 212 configured to control extraction of formation fluid from a formation F and measurements performed on the extracted fluid.

The wireline tool 200 also includes a formation tester 214 having a selectively extendable fluid admitting assembly 216 (which is also commonly referred to as a probe assembly) and a selectively extendable tool anchoring member 218 that are respectively arranged on opposite sides of the body 208. The fluid admitting assembly 216 is configured to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are configured to control the fluid admitting assembly 216 to draw fluid samples from the formation F and to control the fluid analysis module 220 to measure the fluid samples. In some example implementations, the fluid analysis module 220 may be configured to analyze the measurement data of the fluid samples as described herein. In other example implementations, the fluid analysis module 220 may be configured to generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214.

The formation tester 214 of FIG. 2, which may also be deployed on the example drillstring 12 of FIG. 1, may utilize the example methods and apparatus described herein. While the example apparatus and methods described herein are described in the context of drillstrings and/or wireline tools, they are also applicable to any number and/or type(s) of additional and/or alternative downhole tools such as coiled tubing deployed tools. Further, one or more aspects of this disclosure may also be used in other coring applications such as side-wall and/or in-line coring.

Figure 3:
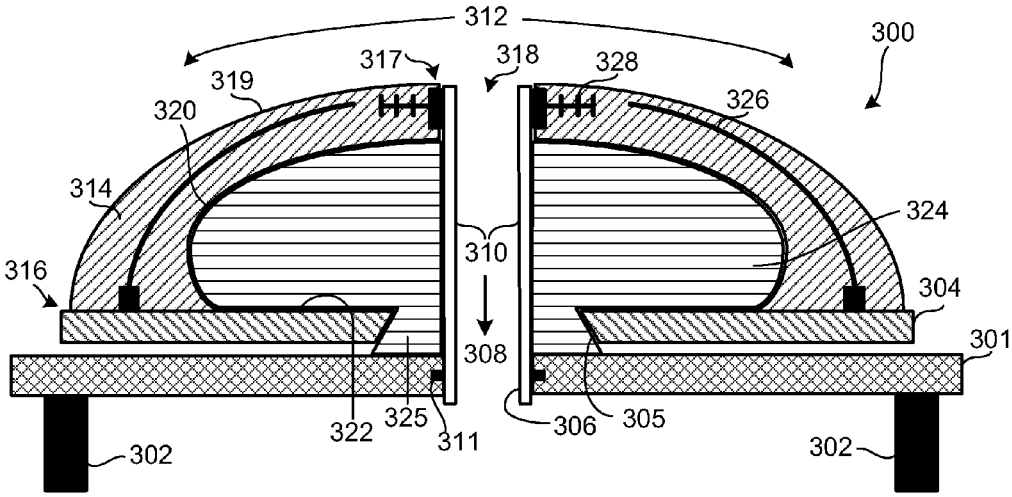
FIG. 3 is a schematic view of apparatus according to one or more aspects of the present disclosure.

FIG. 3 is schematic cross-sectional view of a first example packer 300 configured according to one or more aspects of the present disclosure. The packer 300 may be implemented in association with, for example, the formation tester 214 of FIG. 2 and/or the drillstring 12 of FIG. 1. In particular, the packer 300 of FIG. 3 may be mechanically coupled to the formation tester 214 (not shown in FIG. 3) via a probe shoe 301 coupled to first and second positioning pistons 302. A base plate 304 of the packer 300 is mounted to the probe shoe 301. The positioning pistons 302 may be actuated to extend the probe shoe 301 and, therefore, the packer 300 toward a formation to be tested. As described in detail below, the packer 300 forms a seal against the formation and against the probe shoe 301 when forced against a wall of a borehole.

The base plate 304 includes a central aperture 305 to define an inlet 306 through which formation fluid may be drawn in a direction indicated by arrow 308. During formation testing procedures, and/or during drawing sample fluid into the formation tester 214, a probe barrel 310 is extended through the inlet 306. The probe barrel 310 is disposed within the inlet 306 and may be configured to provide an interference fit with the walls of the inlet 306. The probe barrel 310 may be retractable and extendable along the inlet 306 to make selective contact with a borehole wall and/or to penetrate mud cake lining the borehole wall. The probe barrel 310 may include a screen (not shown) to filter contaminants as formation fluid enters the formation tester 214 via the inlet 306. Furthermore, the probe barrel 310 may be configured to engage and penetrate one or more layers of the borehole wall using one or more protrusions or teeth (not shown) to ensure fluid coupling beyond a damaged portion of a formation adjacent the location of the formation tester. When the probe barrel 310 is retracted into, for example, a travel position, the probe barrel 310 may be recessed relative to an outer surface 312 of the packer 300. Additionally, the probe barrel 310 engages a seal 311, such as an O-ring, as it passes through the probe shoe 301.

Generally, the formation tester 214 forces (e.g., using one or more pistons) the outer surface 312 of the packer 300 against a borehole wall to form a seal therewith. The outer surface 312 is curved to contact normally cylindrical walls of wellbores. With the seal established between the borehole wall and the packer 300, the probe barrel 310 may channel formation fluid through the inlet 306 into the formation tester 214. To draw the fluid through the inlet 306, the formation tester 214 creates a pressure differential that applies a strain on the seal. To withstand this strain and for additional reasons discussed above (e.g., harsh environmental conditions such as high temperatures, wear from repeated contact and applied forces, etc.), the packer 300 is configured as shown in FIG. 3.

For example, the packer 300 includes an outer cover 314 extending from the base plate 304. The outer cover 314 may comprise a shell. The outer cover 314 of FIG. 3 has a first end 316 terminating at the base plate 304 and a second end 317 terminating adjacent a forward opening 318 of the inlet 306. Therefore, in the illustrated example of FIG. 3, the outer cover 314 forms substantially the entire outer surface 312 of the packer 300. The outer cover 314 has an outer surface 319 and an inner surface 320. The inner surface 320 forms an inner cavity 322 with the base plate 304 and the probe barrel 310.

The packer 300 also includes a core 324 disposed within the inner cavity 322 formed by the inner surface 320 of the outer cover 314, the base plate 304, and the probe barrel 310. The core 324 includes a portion 325 extending through the aperture 305 of the base plate 304 to engage the probe shoe 301. This portion 325 forms a seal against the probe shoe 301 when the packer 300 is forced against a borehole wall. In the illustrated example of FIG. 3, the core 324 is a single, solid material molded in the shape of the inner cavity 322. However, in some example implementations, the core 324 may be a bladder filled with, for example, oil, gel, and/or some other fluid or semi-solid material. Alternatively, the core 324 may be molded first and the outer cover 314 may be molded to conform to the shape of the core 324. The outer cover 314 and the core 324 may or may not be bonded together. Regardless of the order of molding (or other construction aspects), the outer cover 314 and the core 324 are configured such that the core 324 is disposed within the inner cavity 322 formed in part by the outer cover 314. This configuration enables the core 324 to support the outer cover 314 when, for example, the outer surface 312 of the packer 300 is forced against a borehole wall, thereby compressing or displacing the outer cover 314.

The core 324 of FIG. 3 is constructed of a first material having a first compliance and the example outer cover 314 of FIG. 3 is constructed of a second material having a second compliance. In the illustrated example, the second material of the outer cover 314 is less compliant (i.e., has a higher rigidity) than the first material of the core 324. Accordingly, the outer cover 314 is better suited to withstand direct exposure to the harsh conditions experienced by the outer surface 312 of the packer 300. The material of the outer cover 314 is selected to maintain its physical properties while exposed to downhole temperatures and stresses caused by contact pressure. For example, the material of the outer cover 314 may be selected to provide a relatively low amount of deterioration due to abrasive contact with different surfaces, such as those associated with a borehole wall. However, at the same time, the material of the outer cover 314 may also be selected to remain sufficiently compliant under downhole conditions to enable the packer 300 to conform to a profile of the borehole wall against which a seal is to be formed. On the other hand, the material of the core 324 is selected to maintain its compliance when exposed to the downhole temperatures. In the example of FIG. 3, the core 324 does not contact the borehole wall and, thus, does not have to withstand abrasive contact with the borehole wall.

To facilitate the application and/or the evenly distribution of sealing pressure against the borehole wall, the relatively more compliant core 324 supports the outer cover 314 in response to a compression or displacement of the outer cover 314. The core 324 is capable of providing the packer 300 with a greater degree of compliance and, thus, an ability to adapt to different sized boreholes and to enable the packer 300 to form a good seal against a variety of different boreholes. Without such ability, additional packers of different sizes and/or shapes may be required to adapt to differently sized boreholes.

Thus, the packer configuration illustrated in FIG. 3 enables the packer 300 to employ a compliant outer cover 314 to form a seal with a borehole wall by supporting the outer cover 314 with the core 324 composed of the second, relatively more compliant material (in comparison to the first material of the outer cover 314). In this manner, the less compliant outer cover 314 can provide a material strength necessary to, for example, sustain the pressure differential created by the draw of fluid by the formation tester 214 and to withstand harsh wellbore conditions (e.g., abrasive contact with the borehole wall), while the more compliant core 324 can provide a greater compliance to enable the packer 300 to conform to the shape of the borehole wall.

To provide additional support to the packer 300 (e.g., by carrying an amount of force applied to the outer surface 312 of the cover 314), the outer cover 314 may include a reinforcement structure 326 disposed between the outer and inner surfaces 319 and 320 of the outer cover 314. The reinforcement structure 326 may be, for example, a metal rib extending from the base plate 304 (as shown in FIG. 3), metal rings, wire rings, wire cable, fiber cable, loose fiber, and/or any other material. Additionally, to provide support for the packer 300 at the highly stressed areas of the outer cover 314 adjacent the forward opening 318 of the inlet 306, the example packer 300 may include an insert 328 constructed of, for example, metal. The example insert 328 shown in FIG. 3 surrounds the forward opening 318 of the inlet 306, reducing the material strength required in that area and, thereby enabling the outer cover 314 to operate similar to an O-ring in creating the seal as described herein.

Figure 4:
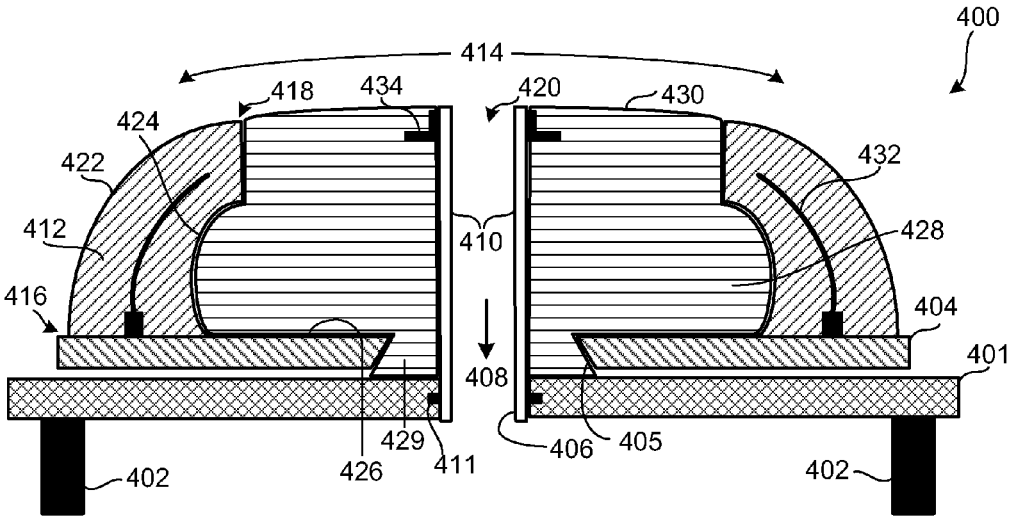
FIG. 4 is a schematic view of apparatus according to one or more aspects of the present disclosure.

FIG. 4 is schematic cross-sectional view of a second example packer 400 configured according to one or more aspects of the present disclosure. The packer 400 may be implemented in association with, for example, the formation tester 214 of FIG. 2 and/or the drillstring 12 of FIG. 1. The packer 400 of FIG. 4 is mechanically coupled to the formation tester 214 via a probe shoe 401 coupled to first and second positioning pistons 402. A base plate 404 is mounted to the probe shoe 401. The base plate has an aperture 405 to define an inlet 406 through which sample formation fluid may be drawn in the direction of the arrow 408. The example packer 400 of FIG. 4 also includes a probe barrel 410 and a seal 411. For purposes of brevity and not limitation, certain aspects and/or operations of the packer 400, such as the probe shoe 401, the first and second positioning pistons 402, the base plate 404, the inlet 406, and the probe barrel 410, are not described in detail in connection with FIG. 4, as these aspects and/or operations are described in connection with other FIGURES of the present disclosure, for example in connection with FIG. 3.

The packer 400 of FIG. 4 includes an outer cover 412 extending from the base plate 404 to form a first portion of an outer surface 414 of the packer 400. The outer cover 412 has a first end 416 terminating at the base plate 404 and a second end 418 terminating at a point along the outer surface 414 between the base plate 404 and a forward opening 420 of the inlet 406. The outer cover 412 has an outer surface 422 and an inner surface 424. The inner surface 424 forms an interior space 426 with the base plate 404 and the probe barrel 410. The outer cover 412 is constructed of a first material having a first compliance, for example similar to the outer cover 314 of FIG. 3. The outer cover 412 may form at least a portion of the sealing surface with the borehole wall. Therefore, the material of the outer cover 412 is compliant enough to conform to a borehole wall but also rigid enough to meet high temperature requirements and to reduce the amount of deterioration that may result from abrasive contact with different surfaces, such as those of a borehole wall.

The packer 400 of FIG. 4 also includes a core 428 disposed within the interior space 426 defined by the inner surface 424 of the outer cover 412, the base plate 404, and the probe barrel 410. The core 428 includes a portion 429 extending through the aperture 405 of the base plate 404 to engage the probe shoe 401. This portion 429 forms a seal against the probe shoe 401 when the packer 400 is forced against a borehole wall. The example core 428 is constructed of a second material having a second compliance greater than the compliance of the outer cover 412. As the core 428 of FIG. 4 is exposed to well fluids and makes contact with the formation to be tested, the example core 428 of FIG. 4 may be less compliant than the core 324 of FIG. 3 and better able to withstand adverse chemical effects of the well fluids. In the illustrated example of FIG. 4, the core 428 is a single, solid material molded in the shape of the interior space 426. However, as described above in connection with FIG. 3, the outer cover 412 may alternatively be molded in the shape of the core 428. In other words, the order of construction operations is interchangeable.

In the example of FIG. 4, an outer surface 430 of the core 428 forms a second portion of the outer surface 414 of the packer 400, while the outer cover 412 forms the first portion of the outer surface 414. In particular, the second portion of the outer surface 414 formed by the outer surface 430 of the core 428 surrounds the forward opening 420 of the inlet 406. Therefore, the seal formed with the borehole wall is formed primarily by the more compliant core 428 (in comparison with the outer cover 412) and secondarily (if at all) by the less compliant outer cover 412 (in comparison with the core 428). As described above, material properties that are suitable to maintain mechanical integrity at higher temperatures may differ from the material properties that are suitable to form a seal. The configuration of the packer 400 of FIG. 4 enables the outer cover 412 to maintain the mechanical integrity of the packer 400 under the stress of the wellbore environment, while the core 428 can provide the necessary compliance at the point of sealing. Thus, the packer 400 is configured to conform to boreholes of varying sizes and shapes to form a seal and also to maintain the seal despite the harsh conditions of a wellbore (e.g., deterioration and/or breakdowns of seal integrity due to high temperatures and/or repeated impacts).

Similar to the packer 300 of FIG. 3, the packer 400 of FIG. 4 may include a reinforcement structure 432 (e.g., a metal rib extending from the base plate 404 (as shown in FIG. 4), metal rings, wire rings, wire cable, fiber cable, loose fiber, and/or any other material) disposed between the outer and inner surfaces 422 and 424 of the outer cover 412. Additionally, the example packer 400 may include an insert 434 constructed of, for example, metal to provide support for the packer 400 at the highly stressed areas of the outer surface 414 adjacent the forward opening 420 of the inlet 406.

Figure 5:
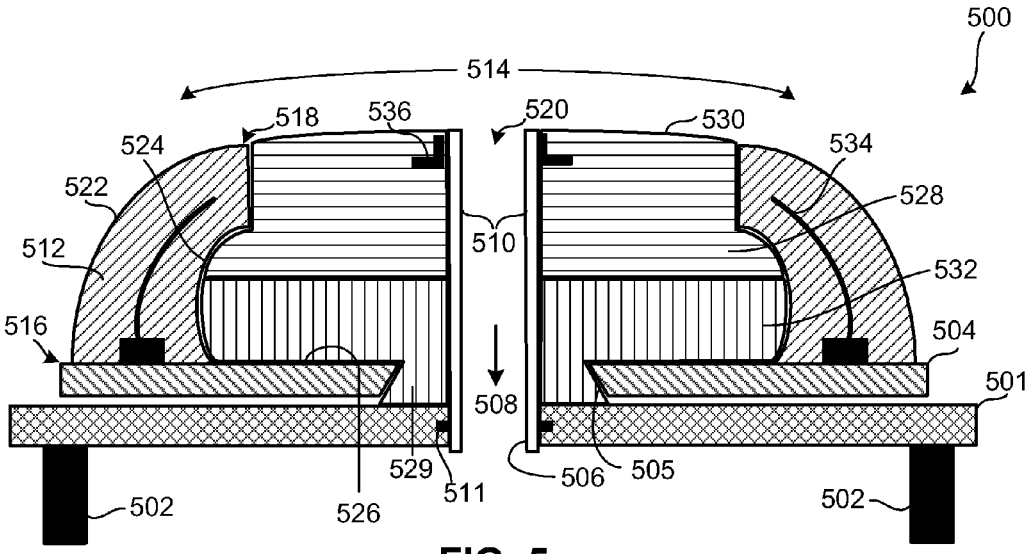
FIG. 5 is a schematic view of apparatus according to one or more aspects of the present disclosure.

FIG. 5 is schematic cross-sectional view of a third example packer 500 configured according to one or more aspects of the present disclosure. The packer 500 may be implemented in association with, for example, the formation tester 214 of FIG. 2 and/or the drillstring 12 of FIG. 1. The packer 500 of FIG. 5 is mechanically coupled to the formation tester 214 via a probe shoe 501 coupled to first and second positioning pistons 502. A base plate 504 is mounted to the probe shoe 501. The base plate 504 has an aperture 505 to define an inlet 506 through which sample formation fluid may be drawn in the direction of arrow 508. The packer 500 also includes a probe barrel 510 and a seal 511. For purposes of brevity and not limitation, certain aspects and/or operations of the probe shoe 501, the first and second positioning pistons 502, the base plate 504, the inlet 506, and the probe barrel 510 of FIG. 5 are not described in detail in connection with FIG. 5, as these aspects and/or operations are described herein in connection with other FIGURES, for example in connection with FIG. 3.

The packer 500 includes an outer cover 512 extending from the base plate 504 to form a first portion of an outer surface 514 of the packer 500. The outer cover 512 has a first end 516 terminating at the base plate 504 and a second end 518 terminating at a point along the outer surface 514 between the base plate 504 and a forward opening 520 of the inlet 506. The outer cover 512 has an outer surface 522 and an inner surface 524. The inner surface 524 forms an interior space 526 with the base plate 504 and the probe barrel 510. The outer cover 512 is constructed of a first material having a first compliance similar to the outer cover 314 of FIG. 3. As described above in connection with FIG. 3, the material of the outer cover 512 can meet high temperature requirements and can reduce the amount of deterioration that may result from abrasive contact with different surfaces, such as those associated with a borehole wall.

The packer 500 also includes a forward core 528 disposed within a forward portion of the interior space 526. The forward core 528 is constructed of a second material having a second compliance greater than the compliance of the outer cover 512. As the core 528 is exposed to well fluids and makes contact with the formation to be tested, the core 528 of FIG. 5 may be less compliant than the core 324 of the packer 300 of FIG. 3 and better able to withstand adverse chemical effects of the well fluids. In the illustrated example of FIG. 5, the forward core 528 is a single, solid material molded in the shape of the forward portion of the interior space 526.

In the example of FIG. 5, an outer surface 530 of the forward core 528 forms a second portion of the outer surface 514 of the packer 500, while the outer cover 512 forms the first portion of the outer surface 514. In particular, the second portion of the outer surface 514 formed by the outer surface 530 of the forward core 528 surrounds the forward opening 520 of the inlet 506. Therefore, the seal formed with the borehole wall is formed primarily by the more compliant forward core 528 (in comparison with the outer cover 512) and secondarily (if at all) by the less compliant outer cover 512 (in comparison with the forward core 528). As described above, material properties that are suitable to maintain mechanical integrity at higher temperatures may differ from the material properties that are suitable to form a seal. The configuration of the packer 500 of FIG. 5 enables the outer cover 512 to maintain the mechanical integrity of the packer 500 under the stress of the wellbore environment, while the forward core 528 can provide the necessary compliance at the point of sealing. Thus, the packer 500 is configured to conform to boreholes of varying sizes and shapes to form a seal, and also to maintain the seal despite the harsh conditions of a wellbore (e.g., deterioration and/or breakdowns of integrity due to high temperatures and/or repeated impacts).

The packer 500 of FIG. 5 also includes a rearward core 532 disposed within a rearward portion of the interior space 526. The rearward core 532 includes a portion 529 extending through the aperture 505 of the base plate 504 to engage the probe shoe 501. This portion 529 forms a seal against the probe shoe 501 when the packer 500 is forced against a borehole wall. In the illustrated example of FIG. 5, the rearward core 532 is constructed of a third material having a third compliance greater than the compliance of the forward core 528. For example, the rearward core 528 may be a bladder that can be filled with, for example, oil, gel, any type of fluid, and/or a semi-solid material. Alternatively, the rearward core 532 may be a solid molded material.

In operation, when a force is applied to the outer surface 514 of the packer 500 (e.g., by the formation tester 214 pressing the packer 500 against a wellbore wall), the forward core 528 compresses and, in turn, applies a force to the rearward core 532. Thus, the rearward core 532 supports the forward core 528 as the forward core 528 forms a seal with a borehole wall. The outer cover 512 restricts the forward core 528 and the rearward core 532 from peripherally displacing, which may adversely affect the seal made by the forward core 528. The rearward core 532 being constructed of a highly compliant material (e.g., a gel-filled bladder) enables the forward core 528 to be constructed of a more rigid (yet still compliant enough to conform to a borehole profile) material than, for example, the core 428 of the packer 400 of FIG. 4.

Similar to the packer 300 of FIG. 3, the packer 500 of FIG. 5 may include a reinforcement structure 534 (e.g., a metal rib extending from the base plate 504 (as shown in FIG. 5), metal rings, wire rings, wire cable, fiber cable, loose fiber, and/or any other material) disposed between the outer and inner surfaces 522 and 524 of the outer cover 512. Additionally, the packer 500 may include an insert 536 constructed of, for example, metal to provide support for the packer 500 at the highly stressed areas of the outer surface 514 adjacent the forward opening 520 of the inlet 506.

Figure 6:
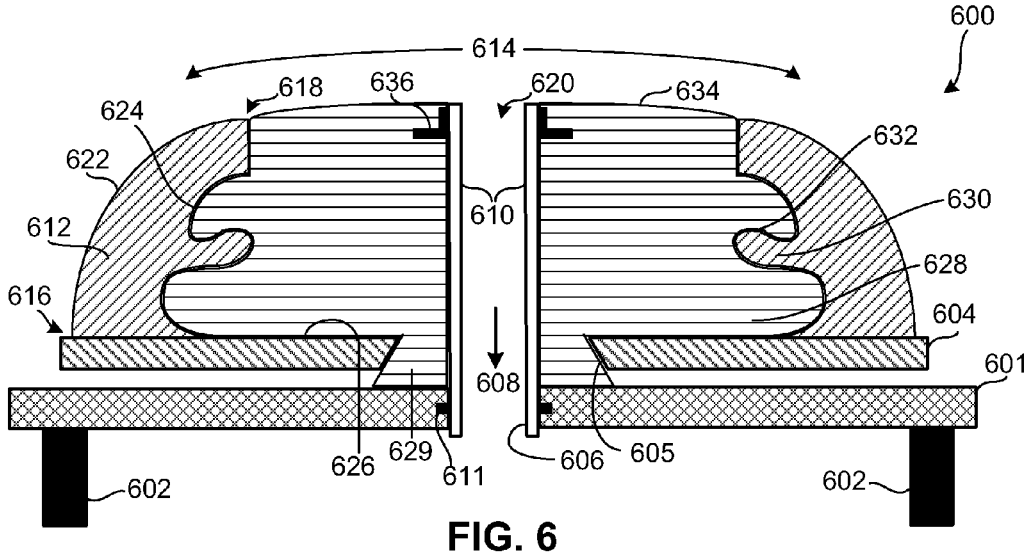
FIG. 6 is a schematic view of apparatus according to one or more aspects of the present disclosure.

FIG. 6 is schematic cross-sectional view of a fourth example packer 600 configured according to one or more aspects of the present disclosure. The packer 600 may be implemented in association with, for example, the formation tester 214 of FIG. 2 and/or the drillstring 12 of FIG. 1. The packer 600 of FIG. 6 is mechanically coupled to the formation tester 214 via a probe shoe 601 coupled to first and second positioning pistons 602. A base plate 604 is mounted to the probe shoe 601. The base plate 604 has an aperture 605 to define an inlet 606 through which sample formation fluid may be drawn in the direction of the arrow 608. The packer 600 of FIG. 6 also includes a probe barrel 610 and a seal 611. For purposes of brevity and not limitation, certain aspects and/or operations of the probe shoe 601, the first and second positioning pistons 602, the base plate 604, the inlet 606, and the probe barrel 610 of FIG. 6 are not described in detail in connection with FIG. 6, as these aspects and/or operations are described above in connection with FIG. 3.

The packer 600 includes an outer cover 612 extending from the base plate 604 to form a first portion of an outer surface 614 of the packer 600. The outer cover 612 of FIG. 6 has a first end 616 terminating at the base plate 604 and a second end 618 terminating at a point along the outer surface 614 between the base plate 604 and a forward opening 620 of the inlet 606. The outer cover 612 has an outer surface 622 and an inner surface 624. The inner surface 624 forms an interior space 626 with the base plate 604 and the probe barrel 610. The outer cover 612 is constructed of a first material having, for example, a compliance similar to the outer cover 314 of FIG. 3. As described above in connection with FIG. 3, the outer cover 612 of the first material can meet high temperature requirements and can reduce the amount of deterioration resulting from abrasive contact with different surfaces, such as the borehole wall.

The packer 600 also includes a core 628 disposed within the interior space 626 defined by the inner surface 624 of the outer cover, the base plate 604, and the probe barrel 610. The core 628 includes a portion 629 extending through the aperture 605 of the base plate 64 to engage the probe shoe 601. This portion 629 forms a seal against the probe shoe 601 when the packer 600 is forced against a borehole wall. The example core 628 is constructed of a second material having a compliance greater than the compliance of the outer cover 612. As the core 628 is exposed to well fluids and makes contact with the formation to be tested, the core 628 may be less compliant than the core 324 of the example packer 300 of FIG. 3 and better able to withstand adverse chemical effects of the well fluids. In the illustrated example of FIG. 6, the core 628 is a single, solid material molded in the shape of the interior space 626. However, as described above in connection with FIG. 3, the outer cover 612 may alternatively be molded in the shape of the core 628. In other words, the order of construction operations is interchangeable.

In the illustrated example of FIG. 6, the inner surface 624 of the outer cover 612 includes a protrusion 630 configured to act as an interlocking structure. In particular, the protrusion 630, which extends inwardly from the inner surface 624 of the outer cover 612, is configured to be received by a corresponding mating feature 632 of the core 628. Thus, the protrusion 630 and the mating feature 632 cooperate to interlock the outer cover 612 and the core 628. In the illustrated example of FIG. 6, in which the core 628 and the outer cover 612 are solid, molded pieces, each of the core 628 and the outer cover 612 can be molded in any order and assembled in any manner. Additional or alternative configurations of protrusion and corresponding mating feature(s) can be optimized for particular stresses to be experienced by additional or alternative packers.

In addition to or instead of the interlocking features 630 and 632 of FIG. 6, the example packers 300, 400, 500, and/or 600 of FIGS. 3-6 described herein may include reinforcement structures that bridge between the outer cover and the core thereof. For example, the reinforcement structure 326 of the example packer 300 of FIG. 3 may bridge between the core 324 and the outer cover 314 such that the core 324 and the outer cover 314 are interlocked. The other example packers described herein can be similarly configured to ensure maintenance of the structural relationship between the core(s) and the covers or shells.

Referring back to FIG. 6, an outer surface 634 of the core 628 forms a second portion of the outer surface 614 of the packer 600, while the outer cover 612 forms the first portion of the outer surface 614. In particular, the second portion of the outer surface 614 formed by the outer surface 634 of the core 628 surrounds the forward opening 620 of the inlet 606. Therefore, the seal formed with the wellbore wall is formed primarily by the more compliant core 628 (in comparison with the outer cover 612) and secondarily (if at all) by the less compliant outer cover 612 (in comparison with the core 628). The configuration of the packer 600 enables the outer cover 612 to maintain the mechanical integrity under the stress of the wellbore environment, while the core 628 can provide the necessary compliance at the point of sealing. Thus, the packer 600 is configured to conform to boreholes of varying sizes and shapes to form a seal and also to maintain the seal despite the harsh conditions of a wellbore (e.g., deterioration and/or breakdowns of integrity due to high temperatures and/or pressures).

Similar to the packer 300 of FIG. 3, the example packer 600 of FIG. 6 may include an insert 636 constructed of, for example, metal to provide support for the packer 600 at the highly stressed areas of the outer surface 614 adjacent the forward opening 620 of the inlet 606.

With respect to the example packers 300, 400, 500 and 600 of FIGS. 3-6, an example of the least compliant material is an HNBR 85 durometer material, such as the Maloney compound 8009. The more compliant core could be the same type of material, but in a formulation with 65 durometer. The 65 durometer material is much more compliant but not as strong as the 85 durometer material. Another example of the material for the inner core is DuPont Viton Extreme with 75 durometer. For example, in FIG. 4, this material may be used to form the core 428, with the 85 durometer HNBR Maloney compound 8009 forming the outer cover 412. Silicon oil in a bladder of Extreme Viton is one possible material combination for a very fluid inner core. In an exemplary embodiment of the packer 500 shown in FIG. 5, the outer cover 512 is composed of about 85 durometer material and at least one of the first and second cores 528, 532 is composed of about 65 durometer material. In another example, the outer cover 512 is composed of about 85 durometer material, the first core 528 is composed of about 75 durometer material, and the second core 532 is composed of about 65 durometer material. In other examples of the packers shown in FIGS. 3-6, the outer cover is composed of a first material that is greater than about 80 durometer material and the one or more cores are composed of a second material that is less than about 70 durometer material. However, the material options described above are merely examples, and other materials are also within the scope of the present application.

In view of the foregoing description and the figures, it should be clear that the present disclosure introduces an apparatus comprising a base plate having a first aperture to receive an inlet in fluid communication with a downhole tool; a shell extending from a peripheral portion of the base plate and having a first surface forming a first portion of an outer surface of a packer and configured to engage a wellbore or borehole wall and a second surface forming an inner cavity with the base plate; a first core having a first surface forming a second portion of the outer surface of the packer and configured to engage the wellbore or borehole wall, a second surface to engage the second surface of the shell forming the inner cavity, and a third surface to engage a first portion of the inlet; and a second core disposed between the first core and the base plate, the second core having a first surface to engage the second surface of the shell forming the inner cavity and a second surface to engage a second portion of the inlet. The shell may comprise a first material, the first core may comprise a second material, the second core may comprise a third material, and the second and third materials may be more compliant than the first material. The first core may comprise a sealing material and the second core may comprise a bladder. The apparatus may further comprise one or more reinforcement strands disposed between the first and second surfaces of the shell. The first core may prevent the second core from contacting the wellbore wall. The downhole tool may be configured for conveyance in a borehole via at least one of a wireline or a drillstring.

The present disclosure also introduces an apparatus comprising a base plate having a first aperture to receive an inlet in fluid communication with a downhole tool; a compliant outer cover having a first end terminating at the base plate and a second end terminating at an opening of the inlet, the compliant outer cover having a first surface configured to engage a wellbore or borehole wall and a second surface forming an inner cavity with the base plate; and a core disposed within the inner cavity and having a second aperture forming at least a portion of the inlet, wherein the outer cover comprises a first material and the core comprises a second material more compliant than the first material. The compliant outer cover may comprise an entire outer surface of a packer to prevent the core from contacting the wellbore or borehole wall. The core may abut the second surface of the compliant outer cover, the base plate and a probe barrel defining the inlet. A first surface of the core may have a curvature substantially similar to a curvature of the second surface of the compliant outer cover. The apparatus may further comprise a support disposed between the first and second surfaces of the compliant outer cover. The support may comprise at least one of a rib or a reinforcing strand. The core may comprise a bladder that may be configured to take a shape of the inner cavity when the bladder is filled. The apparatus may further comprise a second core to be inserted into the inner cavity comprising a third material more compliant than the first material of the outer cover. The apparatus may further comprise a metal insert in the compliant outer cover disposed between the first and second surfaces of the compliant outer cover and adjacent the forward opening of the inlet. The core may be composed of a solid material. The downhole tool may be configured for conveyance in a borehole via at least one of a wireline or a drillstring.

The present disclosure also introduces a method of establishing fluid communication between a downhole tool and a formation, the method comprising extending a packer from the downhole tool against a wellbore or borehole wall; and forming a seal between the wellbore or borehole wall and the packer, an outer surface of the packer being formed by a compliant outer cover having a first end terminating at a base plate and a second end terminating at an opening of an inlet, the outer cover having an inner surface forming an inner cavity with the base plate, wherein a core having an aperture forming at least a portion of the inlet is disposed within the inner cavity, and wherein the outer cover comprises a first material and the core comprises a second material more compliant than the first material. The method may further comprise drawing a sample from the formation into the downhole tool via the inlet by creating a pressure differential. The core may comprise a bladder configured to take a shape of the inner cavity when filled. The compliant outer cover may form the entire outer surface of the packer and may prevent the core from contacting the wellbore or borehole wall. The downhole tool may be configured for conveyance in a borehole via at least one of a wireline or a drillstring or any other conveyance.

The present disclosure also introduces an apparatus comprising: a base plate having an aperture configured to receive an inlet in fluid communication with a downhole tool; an outer cover extending from a peripheral portion of the base plate and having a first surface forming a first portion of an outer surface of a packer and configured to engage a borehole wall and a second surface forming an inner cavity; a first core having a first surface forming a second portion of the outer surface of the packer and configured to engage the borehole wall, a second surface engaging the second surface of the outer cover forming the inner cavity, and a third surface adjacent a first portion of the inlet; and a second core disposed between the first core and the base plate. The base plate may form the inner cavity with the second surface. The second core may have a first surface engaging the second surface of the outer cover forming the inner cavity and a second surface adjacent a second portion of the inlet. The outer cover may comprise a first material, the first core may comprise a second material, and the second core may comprise a third material, and the second and third materials may be more compliant than the first material. The first core may comprise a sealing material and the second core may comprise a bladder. The apparatus may further comprise one or more reinforcement strands disposed between the first and second surfaces of the outer cover. The outer cover may be composed of about 85 durometer material and at least one of the first and second cores may be composed of about 65 durometer material. The outer cover may be composed of about 85 durometer material, the first core may be composed of about 75 durometer material, and the second core may be composed of about 65 durometer material. The downhole tool may be configured for conveyance in a borehole via at least one of a wireline or a drillstring.

The present disclosure also introduces an apparatus comprising: a base plate having a first aperture configured to receive an inlet in fluid communication with a downhole tool; a compliant outer cover having a first end terminating at the base plate and a second end terminating adjacent a forward opening of the inlet, the compliant outer cover having a first surface configured to engage a borehole wall and a second surface forming an inner cavity with the base plate; and a core disposed within the inner cavity and having a second aperture configured to receive at least a portion of the inlet, wherein the compliant outer cover comprises a first material and the core comprises a second material more compliant than the first material. The core may abut the second surface of the compliant outer cover, the base plate and a probe barrel defining the inlet. A first surface of the core may have a curvature substantially similar to a curvature of the second surface of the compliant outer cover. The apparatus may further comprise a support disposed between the first and second surfaces of the compliant outer cover. The support may comprise at least one of a rib or a reinforcing strand. The core may comprise a bladder configured to take a shape of the inner cavity when the bladder is filled. The apparatus may further comprise a second core disposed in the inner cavity and comprising a third material more compliant than the first material of the outer cover. The apparatus may further comprise a metal insert in the compliant outer cover disposed between the first and second surfaces of the compliant outer cover and adjacent the forward opening of the inlet. The core may be composed of a solid material. The first material may be greater than about 80 durometer material and the second material may be less than about 70 durometer material. The downhole tool may be configured for conveyance in a borehole via at least one of a wireline or a drillstring.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a base plate having an aperture configured to receive an inlet in fluid communication with a downhole tool;

an outer cover extending from a peripheral portion of the base plate and having a first surface forming a first portion of an outer surface of a packer and configured to engage a borehole wall and a second surface forming an inner cavity;

a first core having a first surface forming a second portion of the outer surface of the packer and configured to engage the borehole wall, a second surface engaging the second surface of the outer cover forming the inner cavity, and a third surface adjacent a first portion of the inlet; and a second core disposed between the first core and the base plate;

wherein the first core comprises a sealing material and the second core comprises a bladder.

2. The apparatus of claim 1 wherein the base plate forms the inner cavity with the second surface.

3. The apparatus of claim 1 wherein the second core has a first surface engaging the second surface of the outer cover forming the inner cavity and a second surface adjacent a second portion of the inlet.

4. The apparatus of claim 1 wherein the outer cover comprises a first material, the first core comprises a second material, and the second core comprises a third material, and wherein the second and third materials are more compliant than the first material.

5. The apparatus of claim 1 further comprising one or more reinforcement strands disposed between the first and second surfaces of the outer cover.

6. The apparatus of claim 1 wherein the outer cover is composed of about 85 durometer material and at least one of the first and second cores is composed of about 65 durometer material.

7. The apparatus of claim 1 wherein the outer cover is composed of about 85 durometer material, the first core is composed of about 75 durometer material, and the second core is composed of about 65 durometer material.

8. The apparatus of claim 1 wherein the downhole tool is configured for conveyance in a borehole via at least one of a wireline or a drillstring.

9. The apparatus of claim 1 wherein the bladder is filled with a fluid.

10. An apparatus, comprising:

a base plate having a first aperture configured to receive an inlet in fluid communication with a downhole tool;

a compliant outer cover having a first end terminating at the base plate, the compliant outer cover having a first surface configured to engage a borehole wall and a second surface forming an inner cavity with the base plate; and a core disposed within the inner cavity and having a second aperture configured to receive at least a portion of the inlet, wherein the compliant outer cover comprises a first material and the core comprises a second material more compliant than the first material;

wherein the core comprises a bladder configured to take a shape of the inner cavity when the bladder is filled.

11. The apparatus of claim 10 wherein the core abuts the second surface of the compliant outer cover, the base plate and a probe barrel defining the inlet.

12. The apparatus of claim 10 wherein a first surface of the core has a curvature substantially similar to a curvature of the second surface of the compliant outer cover.

13. The apparatus of claim 10 further comprising a support disposed between the first and second surfaces of the compliant outer cover.

14. The apparatus of claim 13 wherein the support comprises at least one of a rib or a reinforcing strand.

15. The apparatus of claim 10 further comprising a second core disposed in the inner cavity and comprising a third material more compliant than the first material of the outer cover.

16. The apparatus of claim 15 wherein the second core comprises an outer surface configured to engage the borehole wall.

17. The apparatus of claim 10 further comprising a metal insert in the compliant outer cover disposed between the first and second surfaces of the compliant outer cover and adjacent the forward opening of the inlet.

18. The apparatus of claim 10 wherein the first material is greater than about 80 durometer material and the second material is less than about 70 durometer material.

19. The apparatus of claim 10 wherein the downhole tool is configured for conveyance in a borehole via at least one of a wireline or a drillstring.

20. The apparatus of claim 10 wherein the compliant outer cover comprises a second end terminating adjacent a forward opening of the inlet and abutting the inlet.

* * * * *